US005848808A

United States Patent [19]

Fenton

[11] Patent Number: 5,848,808

[45] Date of Patent: Dec. 15, 1998

[54] IN-LINE SKATE GUARD

[75] Inventor: Mitchell Fenton, Toronto, Canada

[73] Assignee: Fenton et al., Mississauga, Canada

[21] Appl. No.: 649,182

[22] Filed: May 17, 1996

[51] Int. Cl.[6] ..... A63C 17/20

[52] U.S. Cl. ..... 280/825; 230/811

[58] Field of Search ..... 280/7.12, 7.13, 280/809, 811, 816, 825; 36/132

[56] References Cited

U.S. PATENT DOCUMENTS

| | | | |
|---|---|---|---|
| 3,898,749 | 8/1975 | Famolare, Jr. | 280/816 |
| 4,355,474 | 10/1982 | Grim | 280/825 |
| 4,365,828 | 12/1982 | Hall et al. | 280/825 |
| 4,382,616 | 5/1983 | Olivieri | 280/825 |
| 4,413,842 | 11/1983 | Loredo | 280/825 |
| 5,290,065 | 3/1994 | Kassal | 36/132 |
| 5,303,955 | 4/1994 | Zurnamer | 36/132 |
| 5,513,881 | 5/1996 | DiMeglio et al. | 280/825 |
| 5,522,621 | 6/1996 | Schneider | 280/825 |
| 5,573,275 | 11/1996 | Smith et al. | 280/811 |
| 5,580,094 | 12/1996 | Ruehlam et al. | 280/811 |

FOREIGN PATENT DOCUMENTS

| | | | |
|---|---|---|---|
| 1174706 | 9/1984 | Canada | 280/811 |
| 2065834 | 10/1993 | Canada | 280/825 |

*Primary Examiner*—Brian L. Johnson
*Assistant Examiner*—Frank Vanaman
*Attorney, Agent, or Firm*—Eugene J.A. Gierczak

[57] ABSTRACT

A cover for the wheels of an in-line skate having a plurality of wheels arranged in tandem comprising an elongated retaining channel having a front end, a back end and a base having spaced upstanding side walls, and at least one cavity between the side walls for receiving the plurality of wheels; resilient tensioning structure associated with at least one of said cavities disposed at the front end; whereby the front wheel of the in-line skate is captured between the cavity at the front end and the resilient tensioning structure when forced between the resilient tensioning structure and cavity and whereby the wheels of the in-line skate are releasably secured between the side walls of the channel. The cover may also be used to store the skate in an upright position.

17 Claims, 9 Drawing Sheets

IN-LINE SKATE GUARD

FIELD OF INVENTION

This invention relates to a cover for an in-line skate having a plurality of wheels arranged in tandem alignment, and particularly relates to a cover for the wheels of an in-line skate having a front cavity and resilient tensioning structure strap for capturing the front wheel of the in-line skate.

BACKGROUND OF THE INVENTION

Roller skates have been popular for a number of years. Recently in-line skates having the wheels arranged in tandem alignment have gained popular use.

The wearers of such skates generally have a need for a cover for the wheels of an in-line roller skate to immobilize the wheels so as to permit an individual to walk freely on a smooth surface whether in a store or otherwise. It is therefore desirable for skaters to be provided with a portable device that mounts easily and quickly to the in-line roller skates to immobilize the wheels and provide a stable walking surface, thereby allowing the skater to walk while wearing the skates.

Furthermore, there is also a need for a cover to securely attach to the wheels of an in-line tandem roller blade so as to (a) permit storage of the roller blade in an upright position when not in use;

(b) reduce unwanted rolling when not in use;

(c) reduce damage to the wheels and skate when not in use.

Various covers for roller skates have heretofore been manufactured and produced. For example, U.S. Pat. No. 5,445,415 relates to a flexible cover which receives the tandem in-line wheels of an in-line skate in a holding channel and prevents rotation of the wheels by immobilization thereof.

U.S. Pat. No. 5,303,955 relates to a roller blade guard for in-line roller skates formed of an envelope shaped body of flexible material such as woven nylon, open at the top with a rubbery bottom. The envelope-like body receives the series of aligned wheels and extends up to just below the boot of the skate.

Furthermore, U.S. Pat. No. 5,290,065 relates to a wheel retaining channel having a first loop bridle which extends from one end of the wheel retaining channel and a second loop bridle which extends from the other end of the wheel retaining channel.

Moreover, U.S. Pat. No. 5,236,224 shows a removable wheel cover for an in-line type skate where the cover includes a front boot designed to inwardly receive the skates front wheel. The cover also includes a rear boot designed to inwardly receive the skates rear wheel.

Yet another device is shown in U.S. Pat. No. 4,364,187 which relates to a device to be detachably connected to a roller skate having wheels to facilitate walking including a bottom portion held unto the skate with spring clips. An enclosing wall extends up from the bottom portion to shield the clips and wheels from view.

Finally, U.S. Pat. No. 3,861,697 teaches a roller skate attachment formed as a base member having a plurality of recessed arcuate surfaces to accommodate roller skate wheels and adapted to be removably secured to the shoe unto which the skate is mounted.

DISCLOSURE OF INVENTION

It is an object of this invention to provide an improved cover for an in-line skate.

It is an aspect of this invention to provide a cover for the wheels of an in-line skate comprising, an elongated retaining channel having a front end and a back end for receiving the wheels of the skate; and a resilient tensioning structure associated with the front end for releasably securing the front wheel of the in-line skate.

It is another aspect of this invention to provide a cover for the wheels of an in-line skate having a plurality of wheels arranged in tandem alignment comprising: an elongated retaining channel having a front end, a back end, a base having spaced upstanding side walls and at least one cavity between said side walls for receiving said plurality of wheels; resilient tensioning structure associated with one of the cavities disposed at the front end; whereby the front wheel of the in-line skate is captured between the cavity at the front end and the resilient tensioning structure when forced between the resilient tensioning structure and the cavity and whereby the wheels of said in-line skates are releasably secured between the side walls of the channel.

BRIEF DESCRIPTION OF DRAWINGS

These and other objects and features of the invention shall now be described in relation to the following drawings.

DESCRIPTION

Like parts have been given like numbers throughout the figures.

Figure 1:
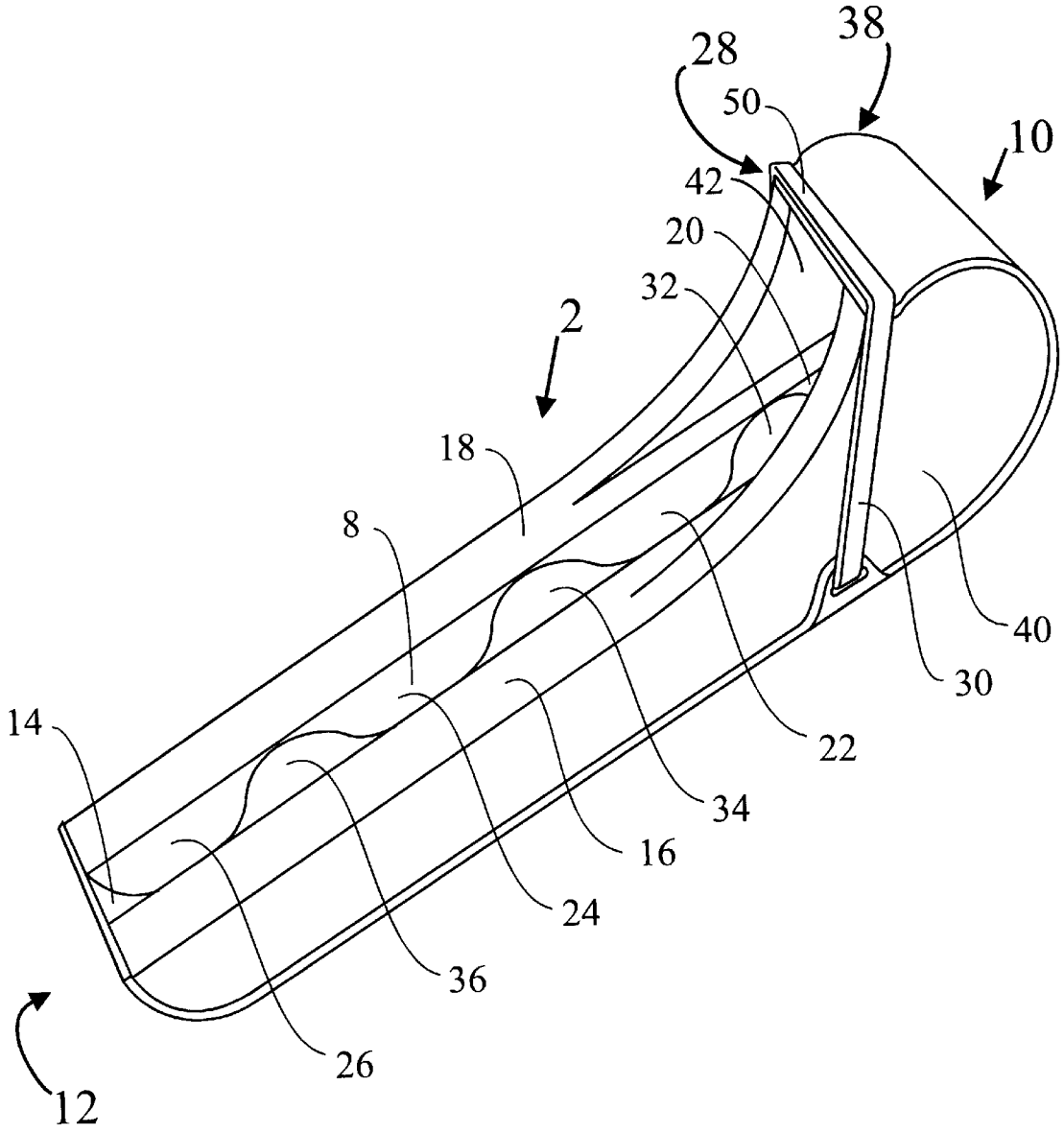
FIG. 1 is a perspective view of the cover.
Figure 2:
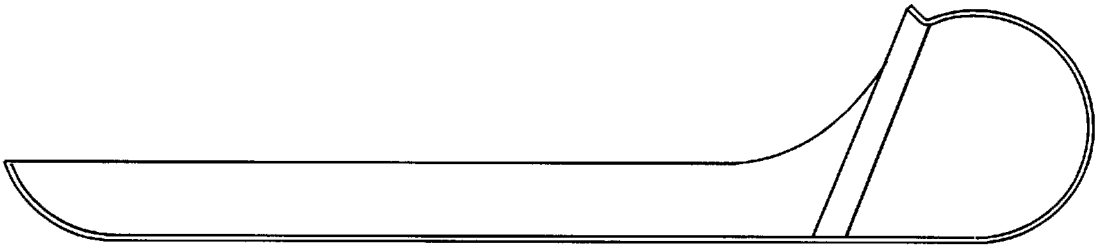
FIG. 2 is a side elevational view of the cover.
Figure 3:
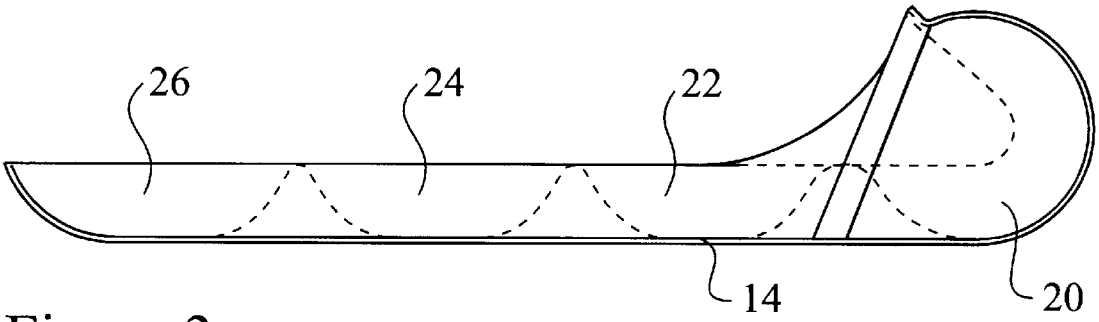
FIG. 3 is a side elevational view of the cover showing the plurality of cavities with hidden lines.
Figure 4:
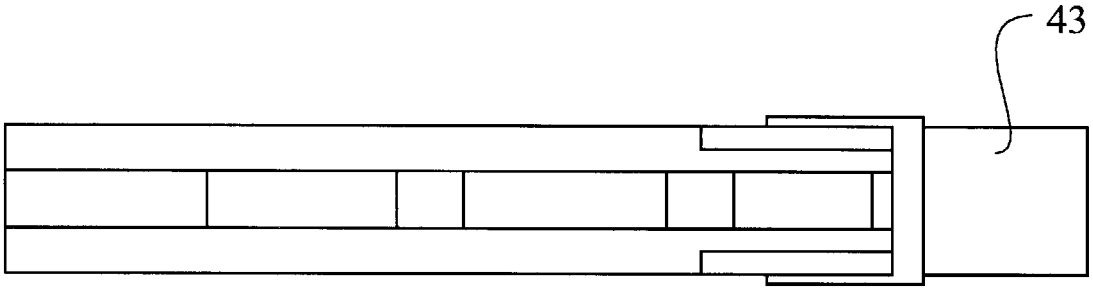
FIG. 4 is a top plan view of the cover.

FIG. 1 generally illustrates the cover 2 for covering the wheels 4 for an in-line skate 6.

The cover 2 comprises an elongated retaining channel 8 which has or is defined by a front end 10, a back end 12, a base 14 and spaced upstanding side walls 16, 40, 18 and 42 and a plurality of cavities 20, 22, 24 and 26.

The cover 2 also includes a resilient tensioning means 28 which is associated with the front end 10 of the cover. In particular, the resilient tensioning means includes a cavity 20 disposed at the front end 10 of the cover 2 and a resilient retaining strap 30. The resilient retaining strap 30 is associated with the front cavity 20.

Figure 5:
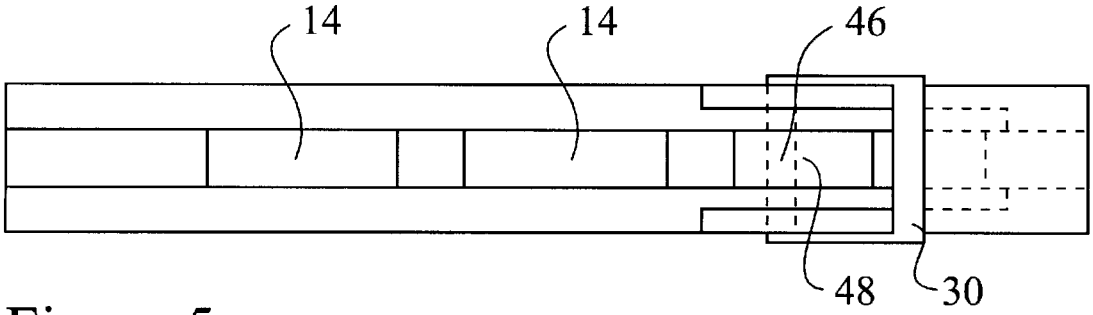
FIG. 5 is a top plan view of the cover showing internal details by hidden lines.
Figure 6:
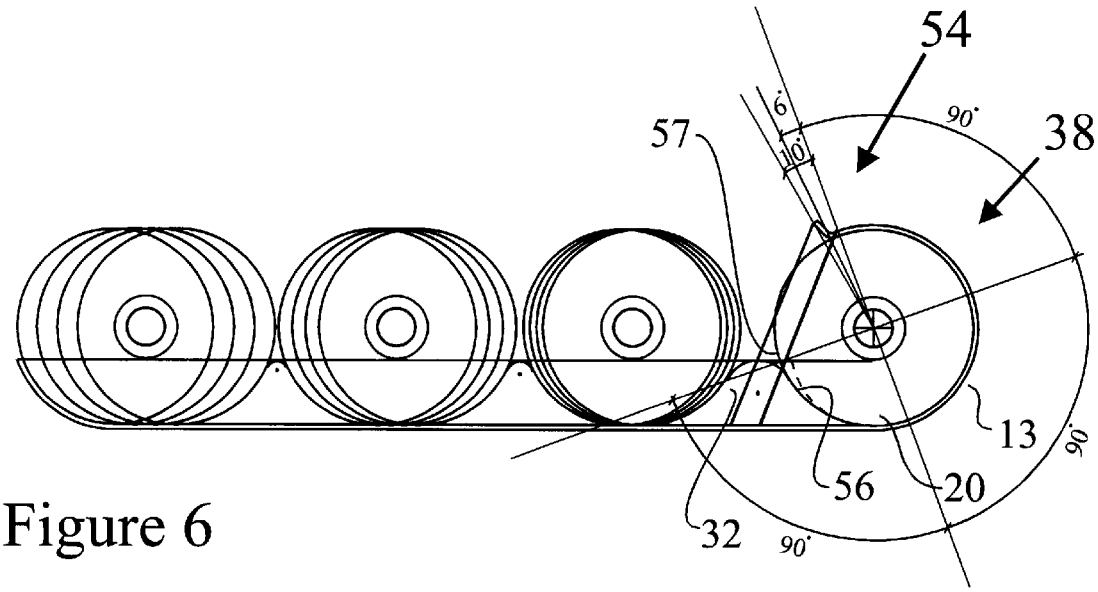
FIG. 6 is a representative side view of the cover side showing relative positioning of the retaining strap and compression area for a four (4) wheel in-line tandem skate.
Figure 7:
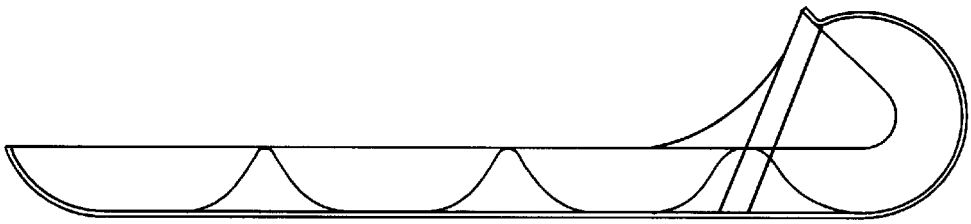
FIG. 7 is a side elevational representative view of a cover for a four (4) wheel in-line tandem skate.
Figure 8:
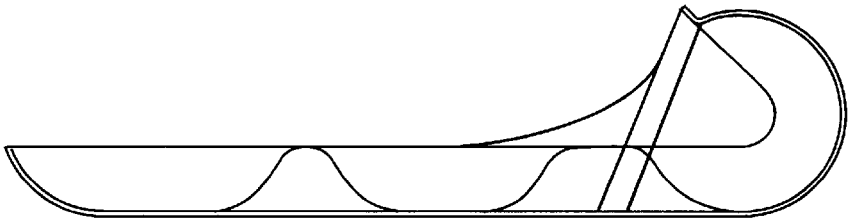
FIG. 8 is a side elevational representative view of a cover for a three (3) wheel in-line tandem skate.

In the embodiment shown in FIGS. 1 –11 the channel 8 includes a plurality of cavities 20, 22, 24 and 26 which are defined by the base 14, plurality of curved partitions 32, 34 and 36 and the upstanding wall portions 16, 40, 18 and 42. The partitions 32, 34 and 36 are adapted to fit between the wheels 4 of the skate as shown in FIG. 6. However, in another embodiment shown in FIGS. 12–19 only one cavity 20 and one curved partition 32 can be utilized in accordance with the teachings of this invention.

The cover 2 also includes a curved toe portion which comprises of extensions 40 and 42 of upstanding side walls 16 and 18.

Figure 9:
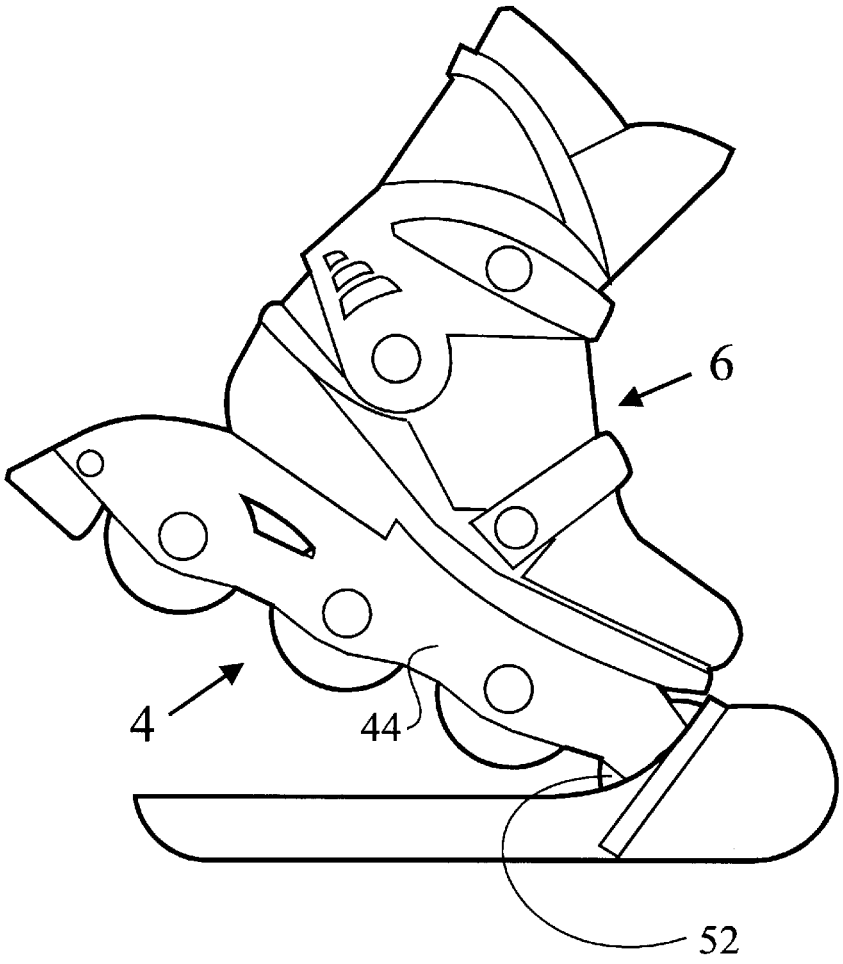
FIG. 9 is side elevational view showing the insertion of the front wheel of a guard into the front cavity and resilient tensioning structure of the cover.
Figure 10:
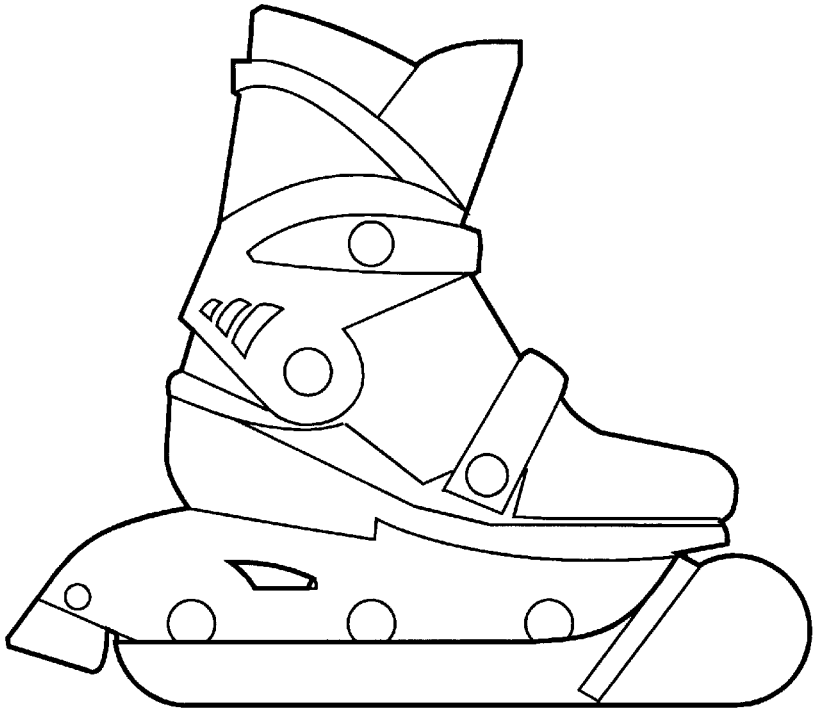
FIG. 10 is a side elevational view showing the wheels of the in-line roller blade skate retained by the channel.
Figure 11:
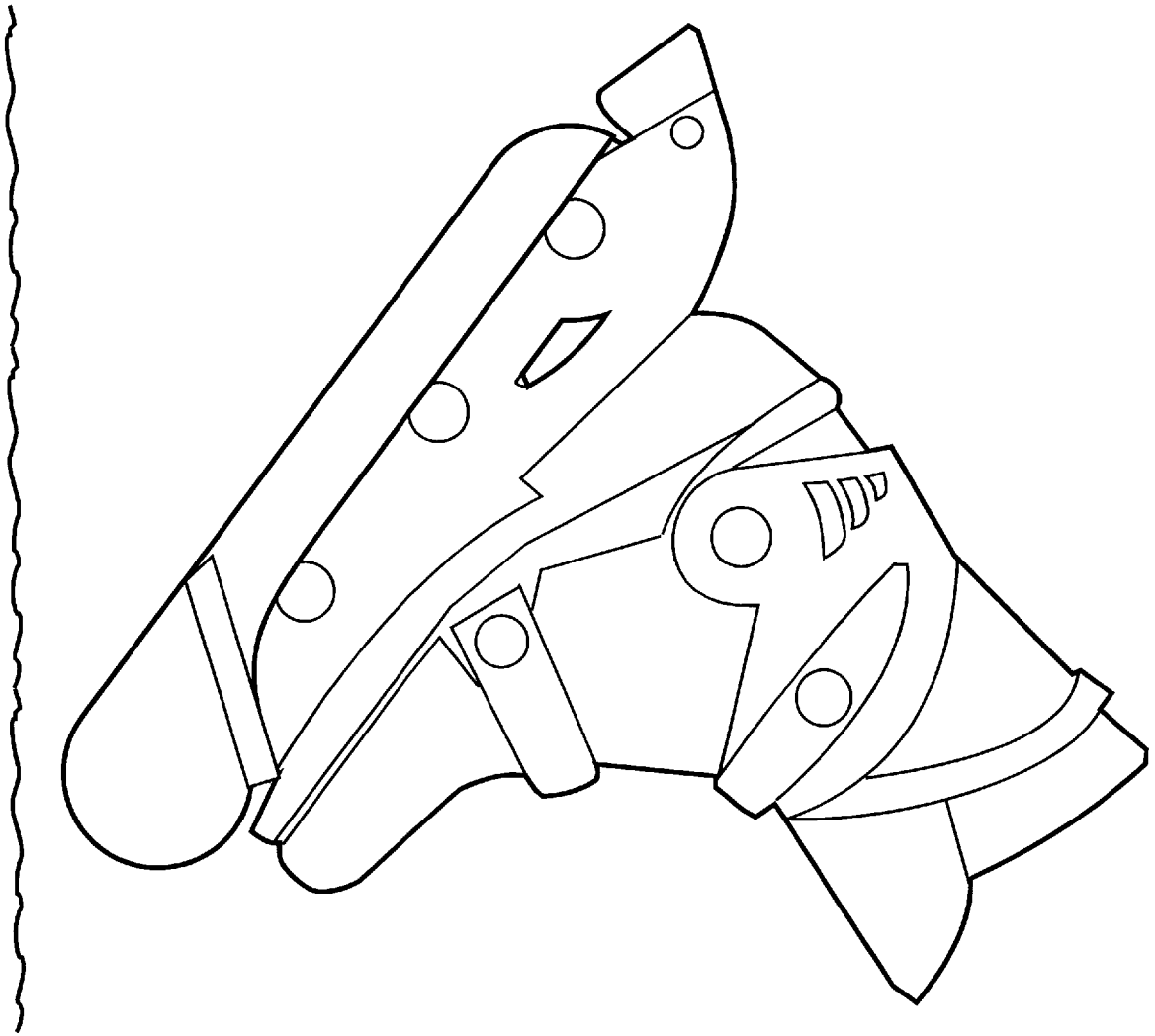
FIG. 11 is a side elevational view showing the securement of the cover to the wheels of a roller blade skate.
Figure 12:
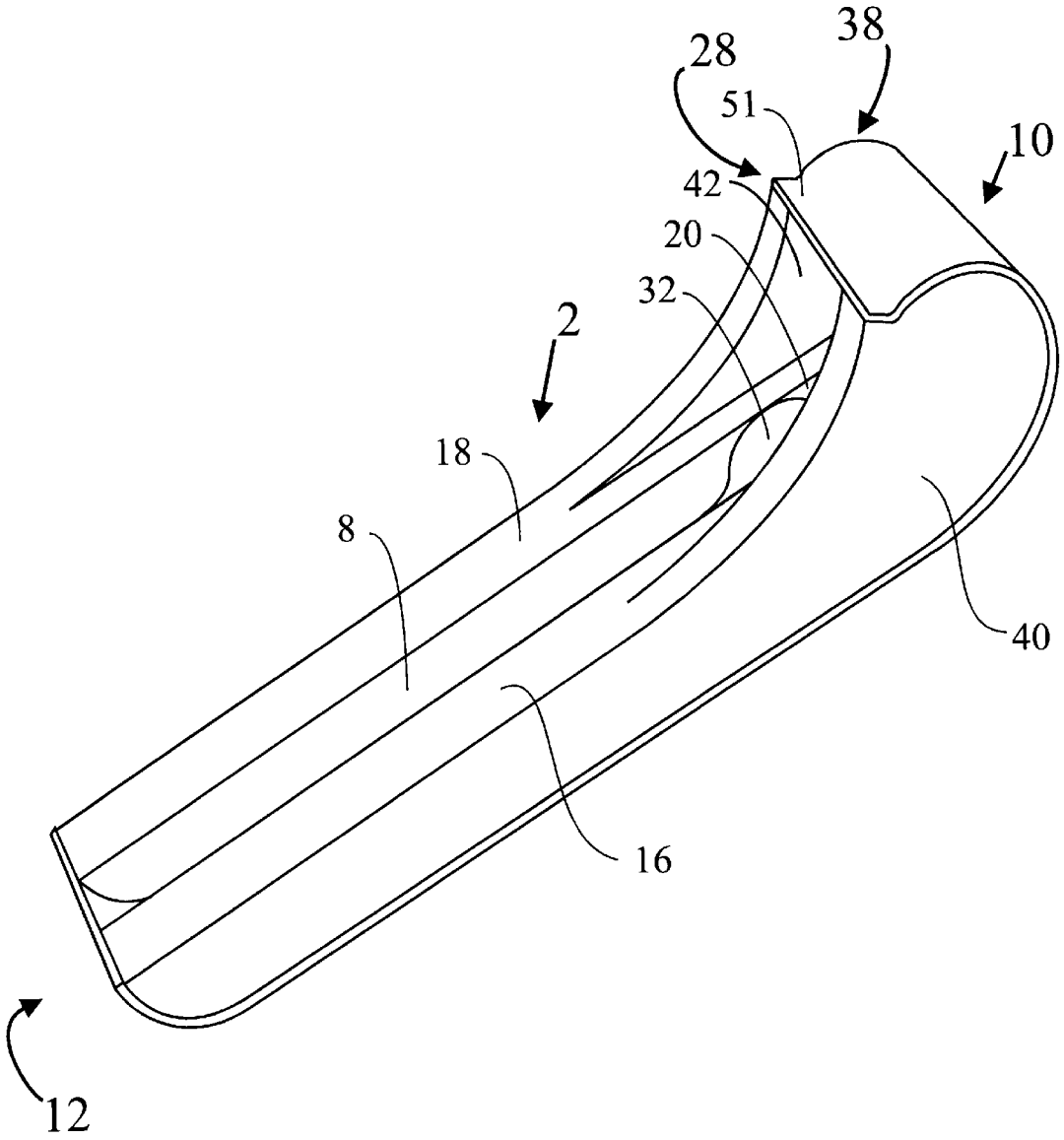
FIG. 12 is a perspective view of a second embodiment of the cover.
Figure 13:
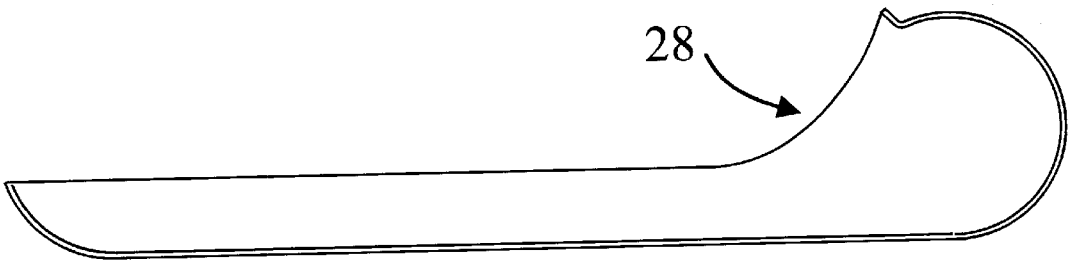
FIG. 13 is a side elevational view of the cover shown in FIG. 12.
Figure 14:
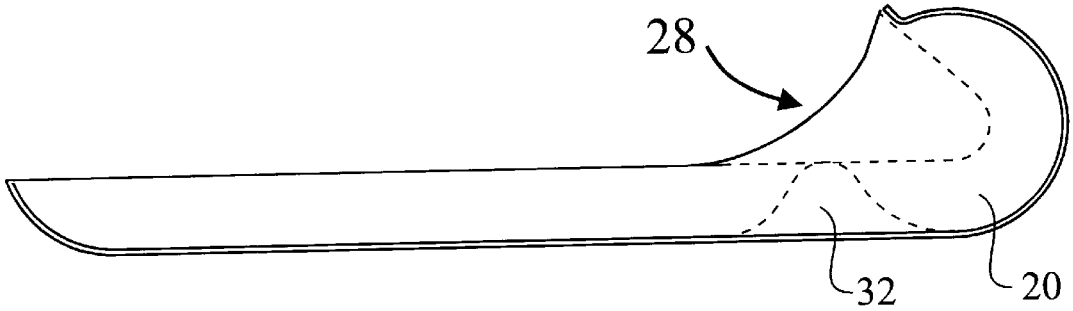
FIG. 14 is a side elevational view of the cover shown in FIG. 12 showing one cavity with hidden lines.
Figure 15:
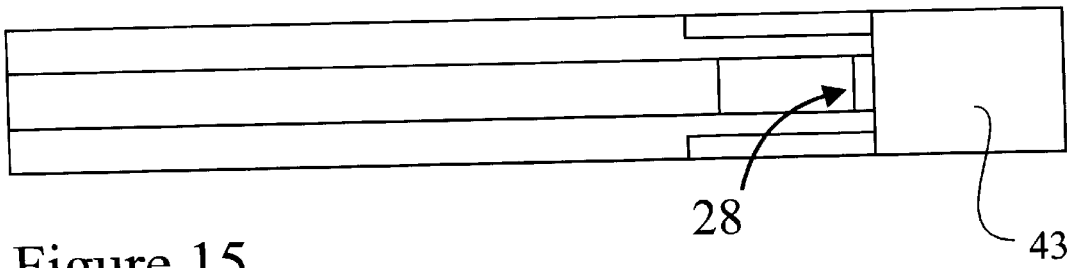
FIG. 15 is a top plan view of the cover shown in FIG. 12.
Figure 16:
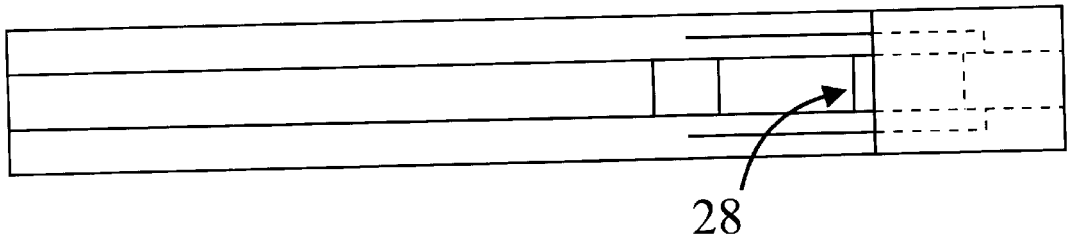
FIG. 16 is a top plan view of the cover shown in FIG. 12 showing internal details by hidden lines.

The channel portion 8 is dimensioned such that the space between the side walls 16 and 18 are adapted to frictionally engage the sides of the wheels 4 is as to resiliently retain same. The space between the upstanding extension wall portions 40 and 42 is greater than the space between the side walls 16 and 18 so as to permit the frictional engagement between the side walls of the housing or retaining structure 44. The housing 44 is adapted to rotationally retain the wheels 4 as shown in FIG. 9. In other words the space between the extensions of toe portion 40 and 42 accommodates the width of the frame 44 as shown in FIG. 10 and 11 while the distance between the side walls 16 and 18 accommodates the thickness of the wheels so as to frictionally engage the same. The front portion of extensions 40 and 42 presents a rounded toe portion.

The upstanding side walls 16 and 18 and curved toe portion 40 and 42 may be comprised of a variety of materials so as to frictionally retain the wheels 4 and housing 44. One material which has been found to be well suited comprises medium density closed cell foam; however other materials can be used.

The base 14 of the cover 2 may be comprised of a variety of materials a and in one embodiment consists of neoprene rubber. The upstanding side walls 16 and 18 and curved toe portion 40 and 42 may be secured to the neoprene rubber base 14 by utilizing appropriate adhesives or other attachment means. The bottom surface of the base 14 includes a treadlike pattern so as to provide traction with the ground when a skater applies the cover 2 over the wheels of a roller blade skate. The base 14 extends forwardly and upwardly so as to present a rounded toe portion 38.

The resilient tensioning means 28 which is associated with the front end 10 of the cover 2 consists of the front cavity 20 and the resilient retaining strap 30. The resilient retaining strap 30 can be made from a variety of materials so long a s it provides the resiliency to be described herein. In one embodiment the resilient retaining strap consists of nylon. The resilient retaining strap 30 has two ends 46 and 48 which are adapted to be inserted under the upstanding side walls 16 and 18 as shown in FIG. 1 and 5, and between the upstanding side walls 16 and 18 and base 14. The nylon retaining strap 30 is secured thereto by a variety of means including utilizing appropriate adhesives or stitching. The top portion 50 of the resilient retaining strap 30 is secured to the top toe portion of base or tread 14 by a variety of means including stitching the top portion 50 to the treadlike portion of base as best shown in FIG. 1.

Accordingly, as the front wheel 52 is inserted into cavity 20 the top portion 50 of the retaining strap 30 is deformed upwardly when forcing the wheel 52 into the cavity 20.

FIG. 6 is a m ore detailed drawing of the cavity 20 and retaining strap 30. The cavity 20 i s defined by partition 32, base or tread 14 which curves upwardly to define a toe portion 38 which terminates at top toe portion 54. The extremity 54 of top toe portion 38 of curved base portion 14 has been stitched to the top portion 50 of retaining strap 30. The cavity 20 has a compression area 56 which forms part of partition 32.

The distance between the start 57 of compression area 56 and extremity 54 which is stitched to retaining strap 30 is less than the diameter of the front wheel 52. The partition or hump 32 is comprised of resilient material such as foam, plastic or the like and is adapted to be compressed as the front wheel 52 is forced down against the partition 32 and the underside of the top portion 50 of retaining strap 30. As the front wheel 52 is forced into the cavity 20 the upstanding portions of the retaining strap 30 tend to be pushed together while the top portion 50 tends to be pushed upwardly and outwardly as shown in FIG. 9 while the partition 32 is compressed. This action causes the front wheel 52 to snap into the cavity 20 so that the front wheel is circumferentially retained by the compression area 56, the curved portion 13 of toe portion 38 right up to the terminal 54. The front wheel 52 is then snugly and securely releasably retained within the cavity 20 between the upstanding curved portions 40 and 42. This action is best illustrated in FIG. 9. Thereafter the user may push down on the skate 6 so that the wheels 4 are frictionally retained in the channel 8 in the appropriate cavities 20, 22, 24 and 26 between partitions 34 and 36. Since the distance between the side walls 16 an d 18 is less than the thickness of the wheel and since the side walls 16 and 18 are comprised of deformable material the remaining wheels are releasably secured in the channel 8 as best shown in FIG. 10. If a user then lifts the skate with the cover 2 the cover is securely retained thereon.

It will be apparent that the user which has the skate attached to the foot may easily and quickly secure the cover to the wheels without the necessity of bending over and manipulating the cover over the wheels with the hands.

Moreover the cover 2 may easily be removed by pressing down on the front wheel 52 with a backward kick action of the skate 6 and then pivoting same so as to rotate the skate 6 as best shown from FIG. 10 to FIG. 9. The user may then press down (that is tap down on the front wheel and simultaneously pull the skate back) on the front wheel 52 so as to compress the compression zone 56 and pull out the front wheel 52 from within the cavity 20.

Accordingly, as the user inserts the front wheel 52 into the cavity 20, the front wheel 52 is then releasably secured therewith in a first locked or resiliently secured position. Once in this first locked resiliently secured position the compression area pushes against the wheel 52 so as to conform to the circumferential profile of the wheel 52.

The retaining strap 30 is positioned so that the cavity 20 resiliently secures the front wheel 52 of the in-line skate 6. In one embodiment the cavity has a circumferential distance from the start of compression 57 to the terminal 54 and covers approximately 75 percent of the circumference of the wheel. In another embodiment approximately 76.66 percent to 77.77 percent of the circumference of the front wheel is resiliently retained by the cavity 20. In particular, the first curved base 13 in toe portion 38 is dimensioned so as to have a radius R which is slightly less than the radius of wheel 52. Since the curved base portion 13 and compression area 56 are resilient along with the resilient strap 30 the circumference of the wheel 52 is resiliently retained within the cavity 20.

The base 14 includes a treadlike pattern 43 which provides good traction to the user.

Accordingly, once the cover 2 is resiliently secured to the wheels 4 a person may walk with the cover secured to the wheels 4 in such a manner so as to permit the user to walk freely in a store, bank, transit system, up stairs, uneven terrain, surface or the like while positively securing the cover to the wheels and preventing the wheels from rotating therein. Caution should be exercised when walking on stairs.

Furthermore, the cover has a base 14 which is wide enough so as to permit a person to store the in-line skates in an upright position when not in use. Furthermore, the cover as disclosed herein may be utilized by a store to display the in-line roller blades in an upright position by securing the cover 2 to the bottom of the wheels in a manner whereby the cover solely permits the skates to be positioned in an upright fashion.

A second embodiment of the invention is shown in FIGS. 12–19 inclusive. Similar parts have been given similar numbers throughout the figures. In particular the channel 8 includes only one cavity 20 at the front end 10 of the cover 2. Moreover, a single partition or hump 32 is utilized. Furthermore, the resilient retaining structure or means 28 is associated with the front end 10 of the cover 2. In particular the resilient tension means or structure 28 shown in FIGS. 12–19 comprises a cavity 20 disposed at the front end 10 of the cover 2 with resilient upstanding curved portions 40 and 42 and top end 51 which is an extension of the base 14 which curves upwardly over toe portion 38.

Figure 17:
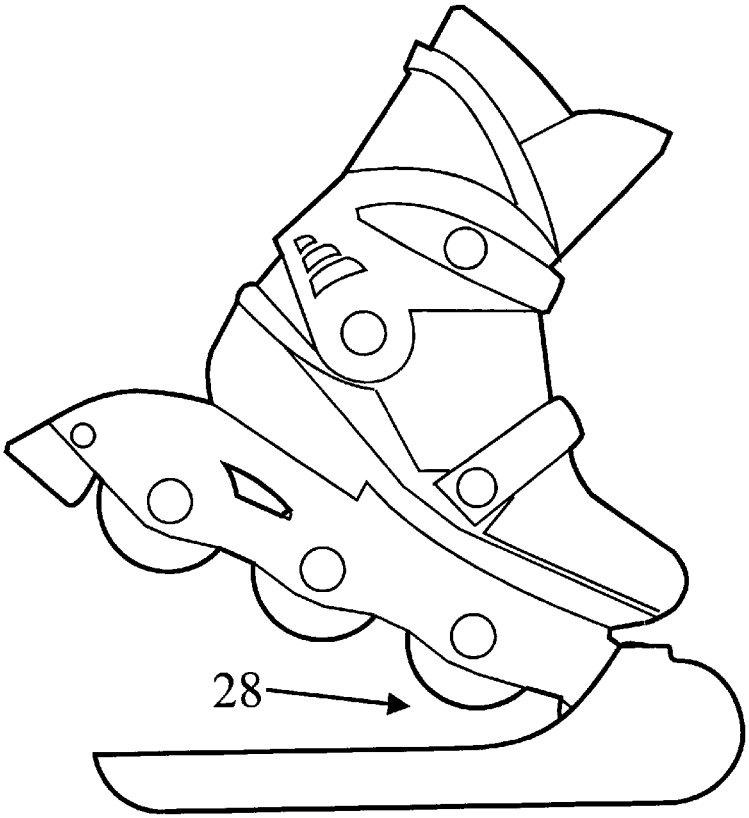
FIG. 17 is a side view showing the insertion of the front wheel of a in-line guard into the front cavity and resilient retaining structure of the cover shown in FIG. 12.
Figure 18:
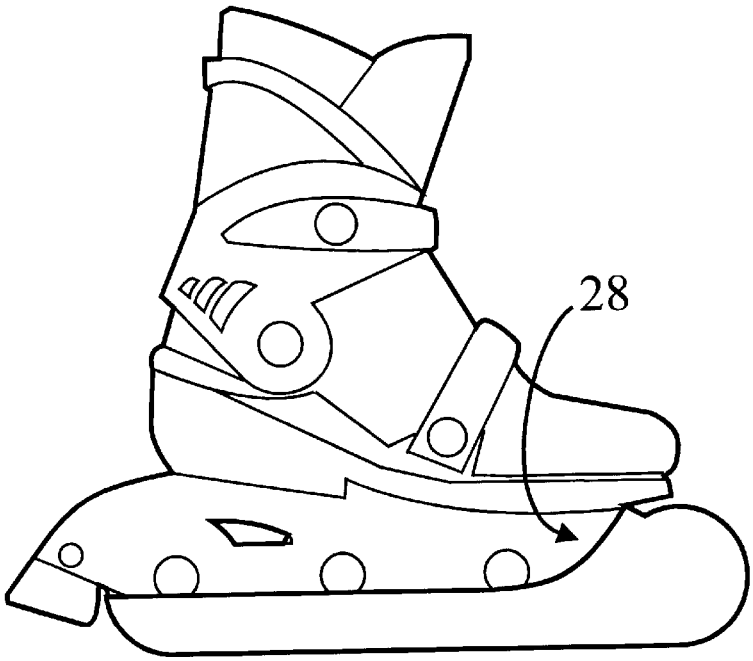
FIG. 18 is a side elevational view showing the wheels of the in-line skate retained by the channel in the cover of FIG. 12.
Figure 19:
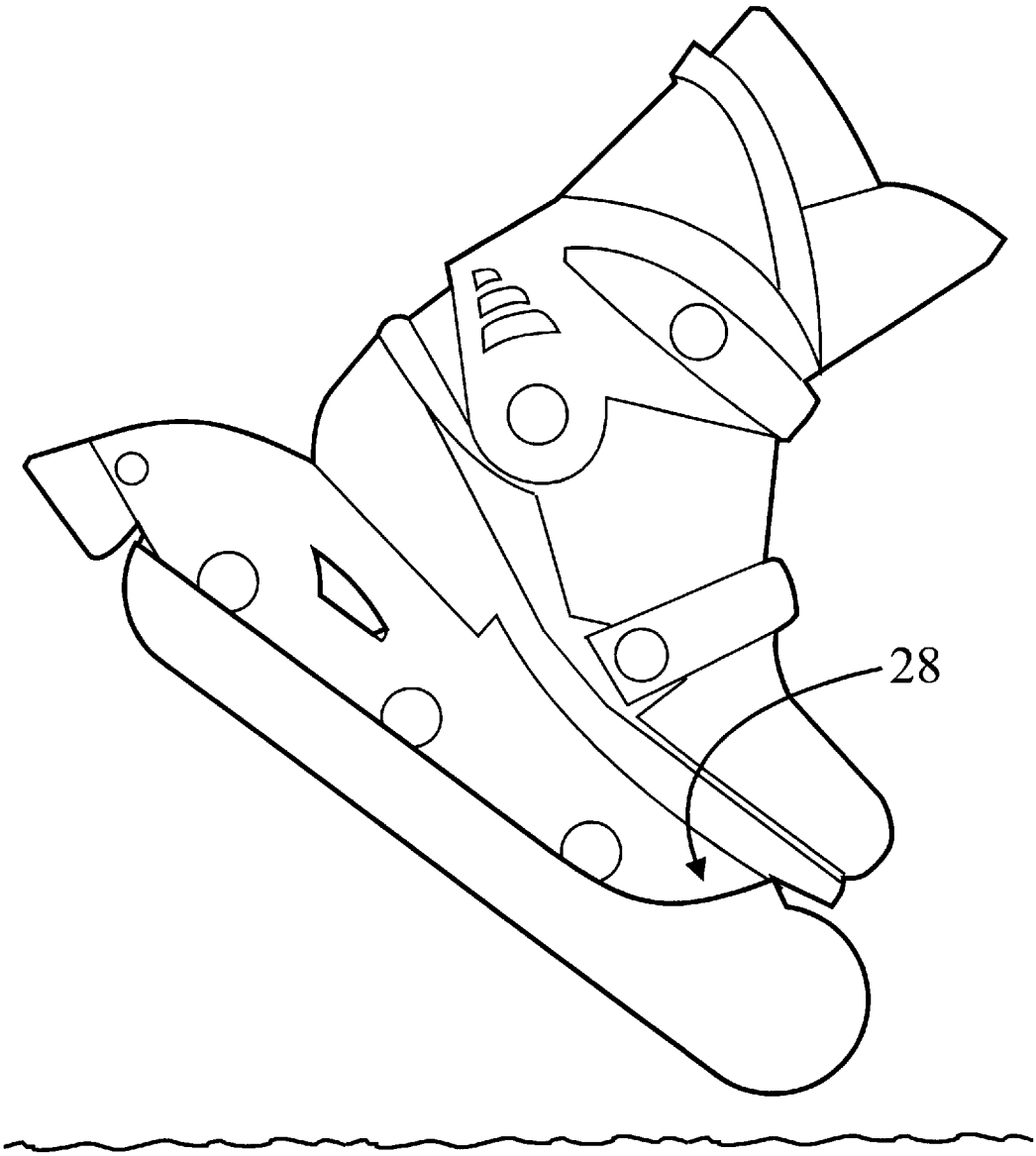
FIG. 19 is a side elevational view showing the securement of the cover to the wheels of the roller of the cover shown in FIG. 12.

The use and action of the embodiment shown in FIGS. 12–19 is as described in FIGS. 1–11. In particular the front wheel 52 is forced into the cavity 20. The upstanding curved portions 40 and 42 tend to be pushed together while the top portion 51 tends to be pushed upwardly and outwardly as shown in FIG. 17. This action causes the front wheel 52 to snap into the cavity 20 so that the front wheel is circumferentially retained by the compression area 56, the curved portion 13 of toe portion 38 right up to the terminal 54. The front wheel 52 is then snuggly and securely releasably retained within the cavity 20 between the upstanding curved portions 40 and 42. Thereafter the user may push down on the skate 6 so that the wheels 4 are frictionally retained in the channel 8 between partitions 34 and 36. Since the distance between the side wall 16 and 18 is less than the thickness of the wheels and since the side wall 16 and 18 are comprised of deformable material the remaining wheels are releasably secured in the channel 8 as best shown in FIG. 18. If the user then lifts the skate with the cover 2 the cover is securely retained therein.

Moreover the cover 2 may easily be removed by pressing down on the front wheel 52 with backward kick action of the skate 6 and then pivoting same so as to rotate the skate 6 as best shown from FIGS. 18–17. The user may then press down on the front wheel 52 so as to compress the compression zone 56 and pull out the front wheel 52 from within the cavity 20.

In the embodiment shown in FIGS. 12–19 the resilient tensioning structure is accomplished by the elastic deformation of upstanding curved side walls 40 and 42 and the top 51.

It is possible that the cover 2 may be extruded from elastic deformable plastics and the resilient tensioning structure comprised of an enlargement or thickening of material in the regions defined by upstanding curved side walls 40, 42 and top 51.

Although the preferred embodiment as well as the operation and use have been specifically described in relation to the drawings, it should be understood that variations in the preferred embodiment could be achieved by a person skilled in the trade without departing from the spirit of the invention as claimed herein.

The embodiments of the invention in which an exclusive property or privilege is claimed are defined as follows:

1. A cover for the wheels of an in-line skate, said skate having a front wheel, comprising:

(a) an elongated retaining channel having a front end and a back end adapted to receive said wheels of said skate;

(b) a cavity disposed at said front end;

(c) resilient tension means associated with said cavity at said front end for releasably securing said front wheel of said in-line skate;

(d) said channel including spaced side walls adapted to grip the sides of said wheels;

(e) said cavity further comprising spaced planar upper side walls extending above said channel side walls and being spaced apart further than said channel side walls.

2. A cover as claimed in claim 1 wherein the distance between said side walls is less then the thickness of said wheels so as to grip the sides of said wheels of said in-line skate.

3. A cover as claimed in claim 2 wherein said cavity includes a compression area and wherein said resilient tensioning means includes resilient retaining straps and where the distance between said compression area and said retaining strap is adapted to be:

(a) less than the diameter of said front wheel of said in-line skate so that said front wheel compresses said compression area when forced into said cavity, and is releasably secured in said cavity between said compression area and said retaining strap.

4. A cover as claimed in claim 1 wherein said resilient tensioning means is adapted to circumferentially grip said front wheel of said in-line skate.

5. A cover as claimed in claim 4 wherein said channel includes a base.

6. A cover for the wheels of an in-line skate having a plurality of wheels including a front wheel arranged in tandem alignment on a frame, the cover comprising:

(a) an elongated retaining channel having a front end, a back end, a base having spaced planar upstanding side walls and at least one cavity between side walls adapted to receive said front wheel;

(b) a compression area associated with said cavity;

(c) resilient retaining means associated with said cavity disposed at said front end;

d said cavity further comprising spaced planar upper side walls extending above said channel side walls and being spaced apart further than said channel side walls;

whereby said compression area is adapted to be compressed when said front wheel is forced into said cavity and said resilient retaining means is adapted to releasably secure said front wheel of said in-line skate and said planar side walls of said channel are adapted to grip the sides of the remaining wheels of said in-line skate.

7. A cover as claimed in claim 6 wherein said base includes a tread.

8. A cover as claimed in claim 7 wherein said cover permits said in-line skate to be stored upright when not in use.

9. A cover as claimed in claim 8 wherein said tread is comprised of neoprene rubber.

10. A cover as claimed in claim 9 wherein said channel is comprised of medium density closed cell foam.

11. A cover as claimed in claim 10 wherein said tread extends up around said cavity so as to present a curved toe portion.

12. A cover as claimed in claim 11 wherein said resilient retaining means extends from said base to said toe portion.

13. A cover as claimed in claim 12 wherein said resilient retaining means is comprised of a resilient retaining strap.

14. A cover as claimed in claim 13 wherein said resilient retaining means and said cavity is adapted to circumferentially grip said front wheel of said in-line skate.

15. A cover as claimed in claim 14 wherein said toe portion is adapted to cover approximately 75 percent of the circumference of said front wheel.

16. A cover as claimed in claim 15 wherein said toe portion is adapted to cover between 76 to 77 percent of said front wheel.

17. A cover as claimed in claim 13 wherein said spaced cavity upper side walls have a distance adapted to be less than the thickness of the skate frame so as to be adapted to frictionally engage said frame and wherein the space between said planar side walls of said channel is adapted to be less than the thickness of said remaining wheels so that the remaining wheels are adapted to be solely frictionally secured by frictional engagement with said side walls of said channel.

* * * * *